US005572773A

United States Patent [19]

Bauer

[11] Patent Number: 5,572,773

[45] Date of Patent: Nov. 12, 1996

[54] MAGNETIC SNAP LOCK

[76] Inventor: Irving Bauer, Rte. 4, Box Y23, Mount Kisco, N.Y. 10549

[21] Appl. No.: 389,189

[22] Filed: Feb. 15, 1995

[51] Int. Cl.[6] ..... A44B 21/00

[52] U.S. Cl. ..... 24/303; 292/251.5

[58] Field of Search ..... 24/303; 292/251.5; 335/285; 70/459

[56] References Cited

U.S. PATENT DOCUMENTS

| | | | |
|---|---|---|---|
| D. 247,467 | 3/1978 | Morita . | |
| 4,021,891 | 5/1977 | Morita . | |
| 4,453,294 | 6/1984 | Morita . | |
| 4,455,719 | 6/1984 | Morita | 24/303 |
| 4,779,314 | 10/1988 | Aoki | 24/303 |
| 5,042,116 | 8/1991 | Ossiani | 292/251.5 |
| 5,142,746 | 9/1992 | Morita | 24/303 |
| 5,208,951 | 5/1993 | Aoki | 24/303 |

FOREIGN PATENT DOCUMENTS

| | | |
|---|---|---|
| 1519246 | 7/1978 | United Kingdom . |

*Primary Examiner*—Victor N. Sakran
*Attorney, Agent, or Firm*—Oblon, Spivak, McClelland, Maier & Neustadt, P.C.

[57] ABSTRACT

A magnetic snap lock includes a female member having first and second plates with a magnetic member mounted to one of the plates. The magnetic snap lock further includes a male member which includes third and fourth plates. In one embodiment of the magnetic snap lock, rivets are utilized to hold the plates of the respective male and female members together. At least one of the rivets can include a small hole which serves to modify a resistance to a magnetic circuit created by the magnetic member and thereby increase a magnetic attraction of the magnetic member. The rivets of either of the male and female members can further include a protruding part for helping align the male and female members together when the male and female members are magnetically attracted to each other. In a further embodiment of the present invention, the plates of the respective female and male members are held together by a deformation or brading of the plates together. Each of the plates includes a central portion which protrude into an opening defined by a magnetic member.

23 Claims, 2 Drawing Sheets

MAGNETIC SNAP LOCK

BACKGROUND OF THE INVENTION

1. Field of the Invention

The present invention relates to a magnetic snap lock which utilizes a permanent magnet. The magnetic snap lock can be used on handbags, pocketbooks, etc. and comprises a female part having a permanent magnet and a male part which is attracted to the female part for magnetically attracting and locking the two parts together.

2. Discussion of the Background

Magnetic locks having male and female parts and using the attraction of a permanent magnet are known. The conventional devices rely upon the strength of the magnetic attraction for achieving the locking of the male and female parts together. However some of the, conventional magnetic locking devices have drawbacks in that they are complicated in structure and in some cases do not provide for a sufficient magnetic attraction to assure an effective locking of the parts to be locked. Additionally, the structure of some conventional magnetic locks makes it difficult to properly align the male and female members.

Also, in some conventional magnetic locks, the mass of the plate on the female member is relatively small and thereby permits a magnetic leakage. This magnetic leakage can adversely effect surrounding items such as credit cards.

SUMMARY OF THE INVENTION

Accordingly, an object of this invention is to provide for a magnetic snap lock which overcomes the above-noted drawbacks of conventional snap locks. In the magnetic snap lock of one embodiment of the present invention, a ferromagnetic rivet is utilized to hold together the respective plates of the male and female members which comprise the magnetic snap lock. One or both of the rivets can be provided at its center with a small hole extending substantially therethrough. The utilization of the small hole through the center of the rivet modifies an interference or resistance to magnetic lines of flux (magnetic circuit) which pass through at least a periphery of the rivet and are caused by a permanent magnet of the female member. By modifying the resistance to the magnetic circuit, the magnetic attraction of the magnetic member is increased.

The present invention also provides for a magnetic snap lock in which the above-noted rivets serve the dual purpose of holding the plates of the female and male members together and also can be used as a guide for guiding and centering the male member with respect to the female member.

The present invention also provides for a magnetic snap lock in which the mass of the bottom plate of the female member is increased to match the mass of the upper plate of the female member. The increase in mass of this embodiment of the female member provides for a more stable device and also lessens any magnetic leakage from the female member.

The structure of the magnetic snap lock of the present invention and also the amount of elements which make up the structure permits the magnetic snap lock to be efficiently mass produced at low cost.

The present invention therefore includes a magnetic snap lock which comprises a female member including a first plate having a first aperture; a second plate adjacent to a first side of the first plate and having a second aperture which is concentric to the first aperture of the first plate; a first rivet which holds the first plate and the second plate together, the first rivet extending through the first and second apertures of the first and second plates; and a magnetic member mounted on a second side of the first plate which is opposite the first side of the first plate, the magnetic member comprising a hole which is in concentric a ligament with the first and second apertures and surrounds a first end portion of the first rivet.

The magnetic snap lock further comprises a male member including a third plate having a third aperture; a fourth plate adjacent to a first side of the third plate and having a fourth aperture which is concentric to the third aperture of the third plate; and a second rivet which holds the third plate and the fourth plate together, the second rivet extending through the third and fourth apertures of the third and fourth plates.

In the present invention, at least one of the first and second rivets comprises a small hole which extends substantially through the at least one rivet. The magnetic member of the female member magnetically attracts and magnetically fastens the male member to the female member by positioning a second end portion of the second rivet within the hole of the magnetic member and adjacent to the first end portion of the first rivet and causing the third plate of the male member to contact and be magnetically fastened to the magnetic member.

The present invention also provides for a magnetic snap lock which comprises a female member including a first plate comprising a first central portion having a first aperture which extends substantially therethrough; a second plate mounted to a first surface of the first plate and comprising a second central portion having a second aperture extending substantially therethrough which is concentric to the first aperture, the second central portion of the second plate extending within the first aperture of the first plate, wherein the first central portion of the first plate and the second central portion of the second plate define a first protruding portion having the second aperture extending substantially therethrough; and a magnetic member which is mounted to a second surface of the first plate, the magnetic member having a through-hole such that the first protruding portion defined by the first and second plates extends into the through-hole.

The male member includes a third plate having a third aperture extending substantially therethrough; and a fourth plate mounted adjacent to the third plate and comprising a fourth central portion, the fourth central portion of the fourth plate extending within the third central aperture of the third plate, wherein the third central portion of the third plate and the fourth central portion of the fourth plate define a second protruding portion.

The magnetic member of the female member magnetically attracts and magnetically fastens the male member to the female member by positioning the second protruding portion of the male member within the through-hole of the magnetic member and adjacent to the first protruding portion of the female member and causes the third plate of the male member to contact and be magnetically fastened to the magnetic member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
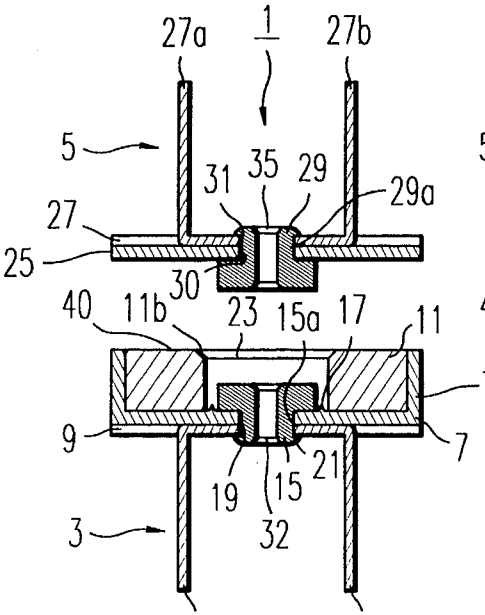
FIG. 1 illustrates an arrangement of the magnetic snap lock of the present invention having a plate which includes an end wall.

Referring now to the drawings, wherein like reference numerals designate identical or corresponding parts throughout the several views, and more particularly to FIG. 1 thereof, FIG. 1 illustrates a first embodiment of the magnetic snap lock of the present invention. FIG. 1 shows a magnetic snap lock 1 including a female member 3 and a male member 5. The female member 3 comprises a first plate 7 having an end wall 7*a* extending therefrom. Mounted adjacent to one side of the first plate 7 is a second plate 9 having first and second legs 9*a* and 9*b* extending therefrom. The first and second legs 9*a* and 9*b* can be utilized for attachment to a flap or the like of a pocketbook, handbag, etc. Mounted on the surface of the first plate 7 is a magnetic member 11 which can be, for example, glued onto the first plate 7. The first plate 7 can include a stepped ridge 17 which serves as a guide and also helps secure the magnet 11 on the plate 7. That is, during production, the magnet 11 can be inserted on the first plate 7 between the space defined by the end wall 7*a* and the stepped ridge 17.

The female member 3 further includes a first rivet 15 which extends through openings 19 and 21 in each of the respective plates 7 and 9. The first rivet 15 includes an indented portion 15*a* which permits each of the first and second plates 7 and 9 to be positioned and held therein. The rivet 15 has a portion which extends within a space 23 defined by the magnetic member 11. 10 The male member 5 includes a first plate 25 and a second plate 27 mounted adjacent to each other and held together by way of a second rivet 29. Like the first rivet 15, the second rivet 29 extends through openings 30 and 31 in each of the first and second plates 25 and 27 and includes an indented portion 29*a* into which portions of the first and second plates 25 and 27 are inserted and held. One or both of the rivets 15 and 29 can have a through hole 32, 35 extending therethrough or substantially therethrough. The second plate 27 of the male member 5 includes leg portions 27*a* and 27*b* for attachment to a flap or the like of a pocket book, handbag etc.

Each of the above-noted plates and rivets can be made of a ferromagnetic material. As illustrated in, for example, FIG. 2, the cooperating female and male members 3 and 5 with the magnet 11 positioned within the female member 3 creates inner and outer magnetic circuits 100 as illustrated by the dashed lines in FIG. 2. The magnetic circuit flows through at least a periphery of the rivets 15 and 29. By utilizing small through-holes such as 32 and 35 substantially through at least one of the rivets 15 and 29, an interference to the magnetic circuit at the center of the rivet 15 or 29 can be modified. The modification in interference at the center will cause a modification in the resistance to the magnetic circuit and thereby increase the magnetic attraction. Accordingly, the provision of having a small hole drilled at least substantially through at least one of the rivets 15 or 29 will modify a resistance to the magnetic circuit and thereby increase the magnetic attraction and holding power of the magnetic snap lock.

In the embodiment of FIG. 1, the first plate 7 includes an end wall 7*a* which entirely overlaps an edge portion of the magnetic member 11. It is believed that the utilization of the end wall 7*a* permits the magnetic snap lock to utilize the outer or secondary magnetic circuit at a vicinity close to the end wall 7*a* and thereby also increases the magnetic attraction of the magnetic snap lock. The end wall 7*a* also facilitates the alignment of the female and male members 3 and 5.

Accordingly, during use, the female member 3 magnetically attracts the male member 5 so as to position the first plate 25 of the male member 5 on the top portion of the magnetic member 11 and end wall 7*a* of the female member 3. The magnetic attraction of the male member 5 towards the female member 3, further positions the second rivet 29 within the opening 23 defined by the magnetic member 11 and adjacent to the first rivet 15. The magnetic member 11 can include tapered portions 11b which help align the second rivet 29 within the opening 23. The small holes (32, 35) extending substantially through at least one of the rivets (15, 29) modifies resistance to the magnetic circuit and thereby enhances the magnetic attraction between the male and female members 3 and 5. Also, the end wall 7*a* of the plate 7 permits the utilization of the outer or secondary circuit at the vicinity of the end wall 7*a* to also enhance the magnetic attraction. The end wall 7*a* also facilitates the alignment between the female and male members 3 and 5.

Figure 2:
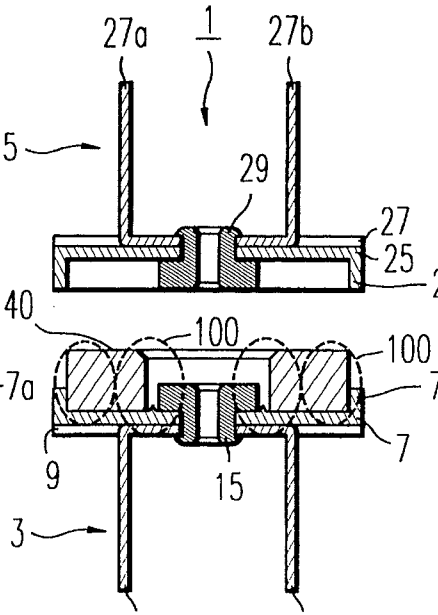
FIG. 2 illustrates an arrangement of the magnetic snap lock of the present invention in which plates of the male and female members include corresponding end walls.

In the magnetic snap lock illustrated in FIG. 2, identical or corresponding parts with respect to FIG. 1 are identified by like reference numerals and therefore, a description of these parts is not repeated. The embodiment of FIG. 2 is similar to the embodiment of FIG. 1, except that in the embodiment of FIG. 2, the first plate 7 of the female member 3 includes an end wall 7*a*' which partially overlaps the magnetic member 11. The first plate 25 of the male member 5 includes an end wall 25*a*' which overlaps a portion of the magnetic member 11 which is not overlapped by the end wall 7*a*' of the first plate 7 of the female member 3 when the female and male members 3, 5 are magnetically fastened to each other. Therefore, in the embodiment of FIG. 2, the combination of the rivets 15 and 29 and the end walls 7*a*' and 25*a*' help align the male member 5 with respect to the female member 3, and the above-noted end walls 7*a*' and 25*a*' form an outer magnetic circuit to increase the magnetic attraction of the female member with respect to the male member. The rivets 15 and 29 in the magnetic snap lock of FIG. 2 have the same function as the rivets in FIG. 1 with respect to the magnetic circuit.

Figure 3:
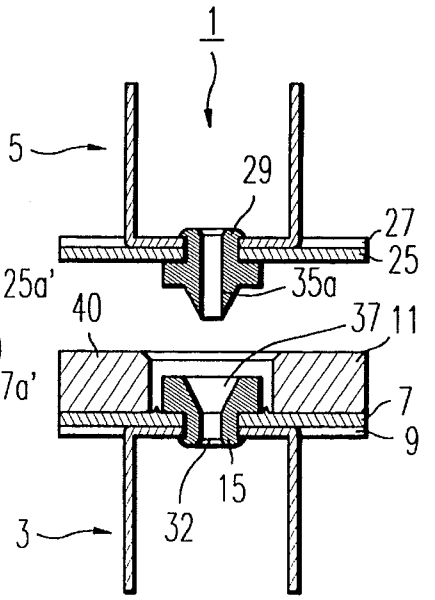
FIG. 3 illustrates the magnetic snap lock of the present invention in which a rivet includes a protruding portion.

In the magnetic snap lock illustrated in FIG. 3, identical or corresponding parts with respect to FIGS. 1 and 2 are identified by like reference numerals and therefore, a description of these parts is not repeated. The embodiment of FIG. 3 is similar to the embodiment of FIGS. 1 and 2 except that each of the first plates 7 and 25 of the female and male members 3, 5 do not include end walls. Additionally, in the embodiment of FIG. 3, the rivet 29 of the male member 5 includes a protruding portion 35*a* which can be inserted into a corresponding widened slanted opening 37 of the rivet 15 of the female member 3. Each or at least one of the rivets 15, 29 can also include the small holes 32, 35. Thus, when the male member 5 is magnetically attracted and fastened to the female member 3, the protruding portion 35*a* of the rivet 29 can be fitted into the widened opening 37 of the rivet 15 to help align the male member 5 with respect to the female member 3.

Figure 4:
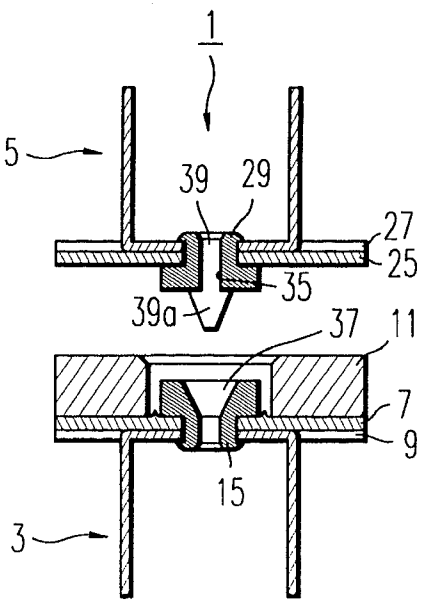
FIG. 4 illustrates the magnetic snap lock of the present invention in which a protruding member is inserted through a small hole in the rivet.

In the magnetic snap lock illustrated in FIG. 4, identical or corresponding parts with respect to FIG. 3 are identified by like reference numerals, therefore a description of these parts is not repeated. The embodiment of FIG. 4 is similar to the embodiment of FIG. 3, however, rather than having the protruding portion 35 formed by the rivet 29 itself, the rivet 29 of the embodiment of FIG. 4 can include a steel or non-ferromagnetic protruding member 39 extending through the through-hole 35 in the rivet 29. The protruding member 39 includes a protruding portion 39*a*. The rivet 15 of the female member 3 can be similar to the rivet of the embodiment of FIG. 3 and also includes a widened opening 37 which corresponds to the protruding portion 39*a* and helps align the male and female members 5, 3 when the protruding portion 39*a* is inserted into the widened opening 37.

Additionally, the magnetic member 11 can be covered with a non-ferromagnetic material 40 as illustrated in FIG. 1. In the embodiments of FIGS. 1 and 2 which include end walls, a space can be defined between the end walls and the magnetic member 11. The space can be either opened or filled with the non-ferromagnetic material 40 as illustrated in each of FIGS. 1 and 2. The non-ferromagnetic material stabilizes the magnetic member.

Figure 7:
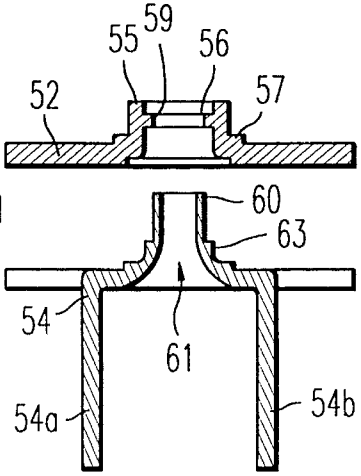
FIG. 7 illustrates the plates of the female member of the magnetic snap lock illustrated in FIG. 5.
Figure 5:
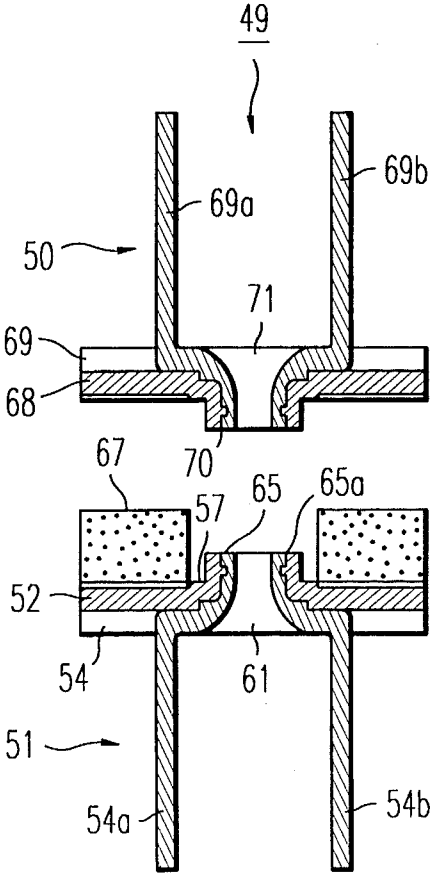
FIG. 5 illustrates the magnetic snap lock of the present invention in which the plates include protruding portions.

FIG. 5 illustrates a further embodiment of the magnetic snap lock of the present invention. As illustrated in FIG. 5, the magnetic snap lock 49 includes a male member 50 and a female member 51. The female member 51 includes a first plate 52 and an adjacent second plate 54. As illustrated in FIG. which is an exploded view of the plates of the female member 1 of FIG. 5, the first plate 52 includes a central portion 5 having an aperture 56 and a stepped ridge 57. The first plate 52 further includes a protruding member 59 which extends within the aperture 56. As further illustrated in FIG. 7, the second plate 54 includes a central portion 60 having an aperture 61 and a stepped portion 63. The second plate 54 further includes leg portions 54*a* and 54*b*.

As illustrated in FIG. 5, the second plate 54 can be mounted to the first plate 52 by inserting the central portion 60 of the second plate 54 within the aperture 56 of the first plate 52. The protruding member 59 of the first plate 52 cooperates with the stepped portion 63 of the second plate 54 to permit the first and second plates 52 and 54 to be attached to each other. After the second plate 54 is inserted into the aperture 56 of the first plate 52, the plates can be attached to each other by, for example, a deformation of the protruding member 59, by brading or welding.

When the first and seconds plates 52 and 54 of the female member 51 are attached to each other as illustrated in FIG. 5, the center portion 55 of the first plate 52 and the center portion 60 of the second plate 54 define a protruding member 65 which extends within an opening 65*a* of a magnet 67 mounted to the plate 52.

In the male member 50, the plates 68 and 69 are attached to each other in the same manner as the plates 52 and 54 are attached to each other in the female member 51 and also define a protruding member 70 which extends towards the female member 51. The plate 69 includes leg portions 69*a* and 69*b*. The leg portions 54*a*, 54*b*, 69*a* and 69*b* can be utilized for attachment to a pocketbook, handbag, etc. The plates 68 and 69 of the male member when attached together also define an opening 71.

In the embodiment of FIG. 5, the male member 50 is attracted to the surface of the magnet 67. The small holes defined by the protruding members 65 and 70 of the plates 52 and 54 or 68 and 69 are effective in reducing interference to a magnetic circuit caused by the magnetic member which passes through at least a periphery of the protruding members 65 and 70 defined by the plates 52 and 54 or 68 and 69.

Additionally, by attaching the plates 52 and 54 or 68 and 69 in the manner described above, the use of a rivet is not necessary. The protruding members 65 and 70 of the plates help to align the male and female members 50 and 51 to each other.

Also, the stepped ridge 57 defined on the plate 52 helps to place the magnetic member 67 on the plate 52. The magnetic member 67 can be glued onto the surface of the plate 52.

Figure 6:
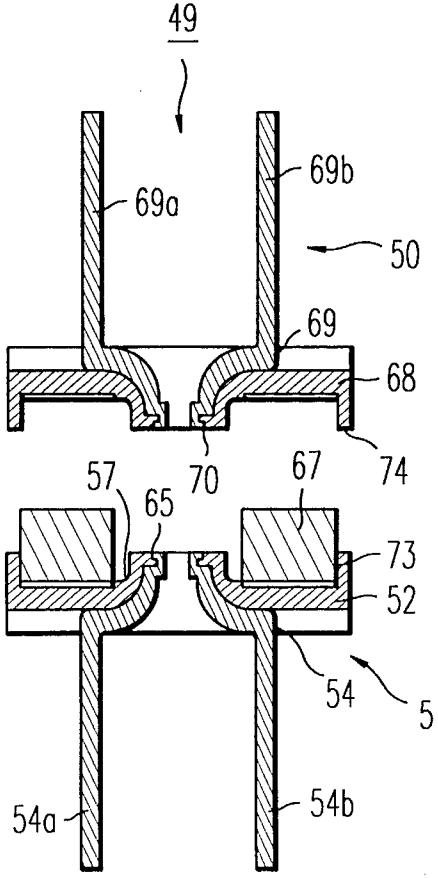
FIG. 6 illustrates the magnetic snap lock of the present invention in which at least one of the plates includes an end wall.

In the magnetic snap lock illustrated in FIG. 6, identical or corresponding parts with respect to FIG. 5 are identified by like reference numerals, therefore a description of these parts is not repeated. The magnetic snap lock 49 of the embodiment of FIG. 6 is similar to the embodiment of FIG. 5, except that the plates 52 and 68 include end walls 73 and 74 which respectively extend from end portions of the plates 52 and 68. The end walls 73 and 74 help to align the female member 51 and the male member 49 together and also serve to form an outer magnetic circuit with respect to the magnetic lines of flux so as to increase the magnetic attraction of the magnetic member.

A combination of the stepped ridge 57 and the end wall 73 serve to enhance the placement of the magnetic member 67 on the plate 52 by providing for a space between the end wall 73 and the stepped ridge 57 on the plate 52 into which the magnetic member 67 can be placed.

Additionally, similar to the embodiments of FIGS. 1–4, the magnetic member 67 can be covered with a non-ferromagnetic material and a space can be defined between the magnetic member 67 and the end walls 73 and 74. The space can be filled with the above-noted non-ferromagnetic material or can be open.

Figure 11:
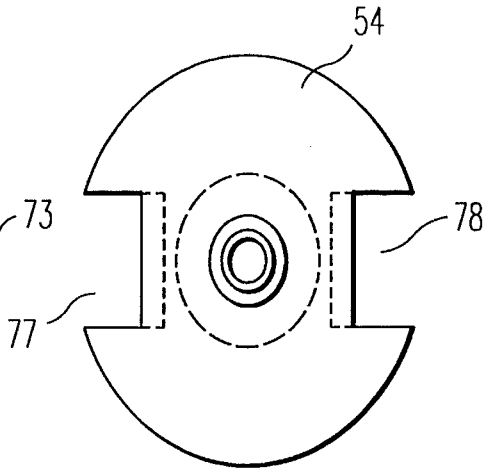
FIG. 11 is a view of the bottom plate of the female member of the magnetic snap lock shown in FIGS. 5 and 6.
Figure 10:
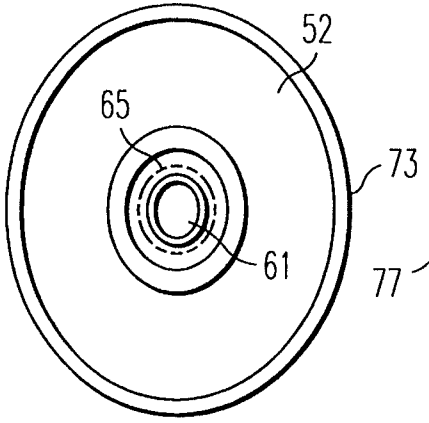
FIG. 10 is a top view of the upper plate of the female member of the magnetic snap lock shown in FIG. 6.
Figure 8:
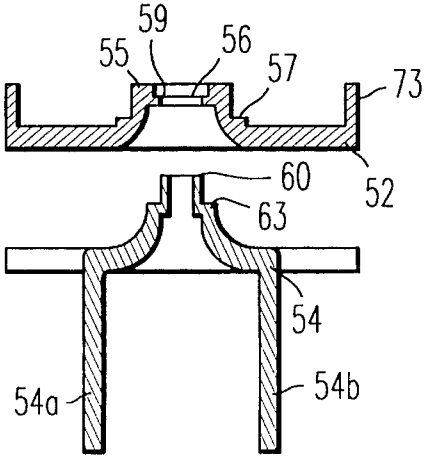
FIG. 8 illustrates the plates of the female member of the magnetic snap lock illustrated in FIG. 6.

FIG. 10 illustrates a view of the upper plate 52 of the female member 51 of FIG. 6. Additionally, FIG. 11 illustrates the lower plate 54 of either of the embodiments of FIGS. 5 and 6. The plate 54 includes cutout portions 77 and 78. The prongs 54*a* and 54*b* can extend from inner portions of the cut out portions 77 and 78. It is noted that the circumference of the plate 54 illustrated in FIG. 11 substantially matches the circumference of the plate 52 illustrated in FIG. 10. Thus, when the plates are mounted to each other as illustrated in FIGS. 5 and 6, an increase in mass of the female member 51 is realized. This provides for a more stable female member and also decreases a magnetic leakage since the bottom plate 54 has a circumference which is substantially equal to the circumference of the top plate 52. By decreasing a magnetic leakage, the magnetic attraction of the female member is increased and a shielding provided by the plate 54 having an increased mass decreases any adverse effects caused by a magnetic field. Also, an increase in magnetic attraction permits the magnetic member to be smaller in size.

Figure 9:
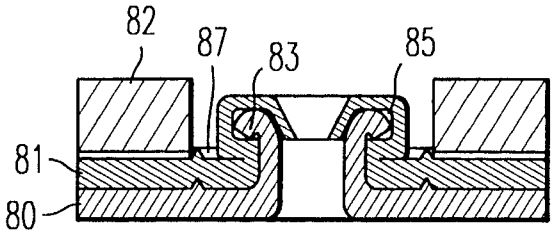
FIG. 9 illustrates in detail an example of a protruding head which can be formed by the two plates of the female member of the magnetic snap lock illustrated in FIGS. 5 and 6.

FIG. 9 illustrates a detail of an alternate method for attaching the first and second plates together. As illustrated in FIG. 9, the bottom plate 80 of a female member can be mounted to a top plate 81 through the use of curved portions 83 of the bottom plate 80 which can be fitted into recesses 85 of the top plate 81. The top plate 81 includes ridges 87 which serve to align the magnet 82 onto the top plate 81.

Figure 12:
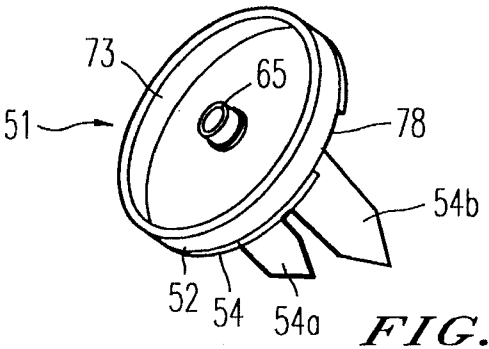
FIG. 12 is a perspective view of the female member of the magnetic snap lock illustrated in FIG. 6.

FIG. 12 is a perspective view of the female member 51 of the embodiment of FIG. 6 and illustrates one of the cutout portions 78. The leg portions 54*a* and 54*b* extend from the cutout portions 77, 78. As shown in FIG. 12, a circumference of the bottom plate 54 is substantially equal to a circumference of the top plate 52 so as to increase the mass of the female member.

As illustrated in FIG. 12, the magnetic snap lock including the plates and magnetic member can be cylindrical in form. However, the shape of the magnetic snap lock including the plates and magnetic members can be based on design considerations and the user's preference.

Accordingly, the present invention provides for a magnetic snap lock which can be efficiently mass produced since the female and male members are basically similar in structure. Additionally, the magnetic snap lock of the present invention provides for an increased magnetic attraction by providing for rivets or protruding portions which help decrease a magnetic resistance. Additionally, the rivets serve to hold the plates which comprise the male and female members together while helping to align the male and female members when they are magnetically attracted to each other.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic snap lock comprising:

(I) a female member including:

(a) a first plate having a first aperture;

(b) a second plate adjacent to a first side of said first plate and having a second aperture which is concentric to the first aperture of said first plate;

(c) a first rivet which holds said first plate and said second plate together, said first rivet extending through the first and second apertures of said first and second plates; and (d) a magnetic member mounted on a second side of said first plate which is opposite said first side of said first plate, said magnetic member having a hole which is concentrically aligned with said first and second apertures and surrounds a first end portion of said first rivet; and (II) a male member including:

(a) a third plate having a third aperture;

(b) a fourth plate adjacent to a first side of said third plate and having a fourth aperture which is concentric to the third aperture of said third plate; and (c) a second rivet which holds said third plate and said fourth plate together, said second rivet extending through the third and fourth apertures of said third and fourth plates;

wherein:

at least one of said first and second rivets includes a small hole which extends from at least one end surface of said at least one rivet; and said magnetic member of said female member magnetically attracts and magnetically fastens said male member to said female member by positioning a second end portion of said second rivet within said hole of said magnetic member and adjacent to said first end portion of said first rivet, causing said third plate of said male member to be magnetically fastened to said magnetic member; and said magnetic member creates a magnetic circuit which passes at least through a periphery of said first rivet of said female member, with said small hole in said one of said first and second rivets increasing the magnetic attraction of said magnetic member by modifying a resistance to said magnetic circuit at said first and second rivets.

2. A magnetic snap lock according to claim 1, wherein said first plate of said female member comprises a first end wall which partially overlaps a periphery of said magnetic member, and said third plate of said male member comprises a second end wall which overlaps a periphery of said magnetic member which is not overlapped by said first end wall of said first plate, said second end wall of said third plate contacting said first end wall of said first plate when said male member is magnetically fastened to said female member, said first and second end walls aligning said first and second rivets when said male and female members are magnetically fastened to each other.

3. A magnetic snap lock according to claim 2, wherein a space is defined between said first and second end walls and said magnetic member when said male and female members are magnetically fastened to each other.

4. A magnetic snap lock according to claim 3, wherein said space is filled with a non-ferromagnetic material.

5. A magnetic snap lock according to claim 1, wherein said first plate of said female member comprises an end wall which completely overlaps a periphery of said magnetic member.

6. A magnetic snap lock according to claim 5, wherein a space is defined between said end wall and said magnetic member.

7. A magnetic snap lock according to claim 11, wherein said space is filled with a non-ferromagnetic material.

8. A magnetic snap lock according to claim 1, wherein said second plate of said female member comprises first and second leg portions, and said fourth plate of said male member comprises third and fourth leg portions resistance to said magnetic circuit at said first and second rivets.

9. A magnetic snap lock according to claim 1, wherein said magnetic member is covered with a non-ferromagnetic material.

10. A magnetic snap lock according to claim 1, wherein said magnetic member is coated with a non-ferromagnetic material.

11. A magnetic snap lock comprising:

(I) a female member including:

(a) a first plate comprising a first central portion having a first aperture extending substantially therethrough;

(b) a second plate mounted to a first surface of said first plate and comprising a second central portion having a second aperture extending substantially therethrough which is concentric to said first aperture, said second central portion of said second plate extending within the first aperture of the first plate, wherein said first central portion of said first plate and said second central portion of said second plate define a first protruding portion having said second aperture extending substantially therethrough; and (c) a magnetic member which is mounted to a second surface of said first plate, said magnetic member comprising a through-hole, such that said first protruding portion defined by said first and second plates extends into said throughhole; and (II) a male member including:

(a) a third plate having a third aperture extending substantially therethrough; and (b) a fourth plate mounted adjacent to said third plate and comprising a fourth central portion, said fourth central portion of said fourth plate extending within the third aperture of the third plate, wherein said third central portion of said third plate and said fourth central portion of said fourth plate define a second protruding portion;

wherein:

said magnetic member of said female member magnetically attracts and magnetically fastens said male member to said female member by positioning said second protruding portion of said male member within said through-hole of said magnetic member and adjacent to said first protruding portion of said female member and causing said third plate of said male member to contact and be magnetically fastened to said magnetic member.

12. A magnetic snap lock according to claim 11, wherein said first plate comprises a first end wall which partially overlaps a periphery of said magnetic member, and said third plate comprises a second end wall which overlaps a periphery of said magnetic member which is not overlapped by said first end wall of said first plate, said second end wall of said third plate contacting said first end wall of said first plate when said male member is magnetically fastened to said female member, said first and second end walls aligning said first and second protruding portions when said male and female members are magnetically fastened to each other.

13. A magnetic snap lock according to claim 12, wherein said first plate comprises a stepped ridge which surrounds a lower part of said first central portion of said first plate, said magnetic member being mounted between said end wall and said stepped ridge of said first plate when said magnetic member is mounted on said first plate.

14. A magnetic snap lock according to claim 12, wherein a space is defined between said first end wall of said first plate and said magnetic member.

15. A magnetic snap lock according to claim 14, wherein said space is filled with a non-ferromagnetic material.

16. A magnetic snap lock according to claim 11, wherein a circumference of said second plate substantially equals a circumference of said first plate, said second plate having opposing cut-out portions with first and second leg portions extending from said opposing cut-out portions.

17. A magnetic snap lock according to claim 11, wherein said magnetic member creates a magnetic circuit which passes at least through a periphery of said first protruding portion of said female member, said first protruding portion having said second aperture extending substantially therethrough increasing a magnetic attraction of said magnetic member by modifying a resistance to said magnetic circuit at said first protruding portion.

18. A magnetic snap lock according to claim 11, wherein said first plate comprises a stepped ridge which surrounds a lower part of said first central portion of said first plate and abuts against a lower end of said magnetic member mounted on said first plate.

19. A magnetic snap lock according to claim 11, wherein said magnetic member is covered with a non-ferromagnetic material.

20. A magnetic snap lock according to claim 11, wherein one of said first and second plates of said female member and one of said third and fourth plates of the male member comprise attaching parts which respectively fit into corresponding recesses on the other of said first and second plates of the female member and the other of the third and fourth plates of the male member.

21. A magnetic snap lock according to claim 20, wherein said first plate is attached to said second plate, and said third plate is attached to said fourth plate, by a deformation of said attaching part fitted into said corresponding recess.

22. A magnetic snap lock comprising:

(I) a female member including:

(a) a first plate having a first aperture;

(b) a second plate adjacent to a first side of said first plate and having a second aperture which is concentric to the first aperture of said first plate;

(c) a first rivet which holds said first plate and said second plate together, said first rivet extending through the first and second apertures of said first and second plates; and (d) a magnetic member mounted on a second side of said first plate which is opposite said first side of said first plate, said magnetic member including a hole which is concentrically aligned with said first and second apertures and surrounds a first end portion of said first rivet; and (II) a male member including:

(a) a third plate having a third aperture;

(b) a fourth plate adjacent to a first side of said third plate and having a fourth aperture which is concentric to the third aperture of said third plate; and (c) a second rivet which holds said third plate and said fourth plate together, said second rivet extending through the third and fourth apertures of said third and fourth plates;

wherein:

at least one of said first and second rivets includes a small hole which extends from at least one end surface of said at least one rivet;

said magnetic member of said female member magnetically attracts and magnetically fastens said male member to said female member by positioning a second end portion of said second rivet within said hole of said magnetic member and adjacent to said first end portion of said first rivet and causing said third plate of said male member to be magnetically fastened to said magnetic member; and said first rivet comprises said at least one small hole and said second rivet comprises a further small hole, and the second end portion of said second rivet defines a protruding portion which is inserted into said at least one small hole of said first rivet when said male member is magnetically fastened to said female member.

23. A magnetic snap lock comprising:

(I) a female member including:

(a) a first plate having a first aperture;

(b) a second plate adjacent to a first side of said first plate and having a second aperture which is concentric to the first aperture of said first plate;

(c) a first rivet which holds said first plate and said second plate together, said first rivet extending through the first and second apertures of said first and second plates; and (d) a magnetic member mounted on a second side of said first plate which is opposite said first side of said first plate, said magnetic member including a hole which is concentrically aligned with said first and second apertures and surrounds a first end portion of said first rivet; and (II) a male member including:

(a) a third plate having a third aperture;

(b) a fourth plate adjacent to a first side of said third plate and having a fourth aperture which is concentric to the third aperture of said third plate; and (c) a second rivet which holds said third plate and said fourth plate together, said second rivet extending through the third and fourth apertures of said third and fourth plates;

wherein:

at least one of said first and second rivets includes a small hole which extends from at least one end surface of said at least one rivet;

said magnetic member of said female member magnetically attracts and magnetically fastens said male member to said female member by positioning a second end portion of said second rivet within said hole of said magnetic member and adjacent to said first end portion of said first rivet and causing said third plate of said male member to be magnetically fastened to said magnetic member; and said first rivet comprises said at least one small hole and said second rivet comprises a further small hole, said second rivet further comprising a protruding member which extends through the further small hole of said second rivet and protrudes beyond said second end portion of said second rivet, said protruding member being inserted into said at least one small hole of said first rivet when said male member is magnetically fastened to said female member.

* * * * *